US011111672B2

(12) United States Patent
Gould

(10) Patent No.: US 11,111,672 B2
(45) Date of Patent: Sep. 7, 2021

(54) SUSPENDED CEILING ARRANGEMENTS

(71) Applicant: Astra Technologies UK LLP, West Sussex (GB)

(72) Inventor: Graham Timothy Gould, West Sussex (GB)

(73) Assignee: ASTRA TECHNOLOGIES UK LLP, West Sussex (GB)

( * ) Notice: Subject to any disclaimer, the term of this patent is extended or adjusted under 35 U.S.C. 154(b) by 0 days.

(21) Appl. No.: 16/628,668

(22) PCT Filed: Jul. 6, 2018

(86) PCT No.: PCT/GB2018/051922
§ 371 (c)(1),
(2) Date: Jan. 4, 2020

(87) PCT Pub. No.: WO2019/008385
PCT Pub. Date: Jan. 10, 2019

(65) Prior Publication Data

US 2020/0123771 A1 Apr. 23, 2020

(30) Foreign Application Priority Data

Jul. 7, 2017 (GB) ..... 1710939

(51) Int. Cl.
*E04B 9/28* (2006.01)
*E04B 9/04* (2006.01)
(Continued)

(52) U.S. Cl.
CPC ..... *E04B 9/28* (2013.01); *E04B 9/0435* (2013.01); *E04B 9/0478* (2013.01); *E04B 9/183* (2013.01); *E04B 9/244* (2013.01); *E04B 9/06* (2013.01)

(58) Field of Classification Search
CPC ..... E04B 9/02; E04B 9/0435; E04B 9/0478; E04B 9/06; E04B 9/183; E04B 9/24; E04B 9/241; E04B 9/244; E04B 9/28
See application file for complete search history.

(56) References Cited

U.S. PATENT DOCUMENTS 2,895,180 A * 7/1959 Byssing ..... E04B 9/28 52/779
3,087,205 A * 4/1963 Mancini ..... E04B 9/064 52/506.08
(Continued)

FOREIGN PATENT DOCUMENTS

DE 29502438 U1 4/1995
DE 202004009657 U1 9/2004
(Continued)

OTHER PUBLICATIONS

International Search Report and Written Opinion from European Patent Office in PCT/GB2018/051922 dated Oct. 25, 2018.
(Continued)

*Primary Examiner* — James M Ference
(74) *Attorney, Agent, or Firm* — Keusey & Associates, P.C.

(57) ABSTRACT

A suspended ceiling arrangement for cleanroom applications includes an elongate support member and a ceiling member. The support member includes a base wall, a side wall, a flange part and a tab which together define a longitudinally extending support channel. The ceiling member includes a base wall, a side wall, a flange part and a lip part. The lip part defines a gap therein. In use, in an installed condition, the ceiling member flange part locates on top of the support member flange part, the lip part locates in the support channel and the tab locates in the gap.

20 Claims, 4 Drawing Sheets

(51) Int. Cl.

| | |
|---|---|
| ***E04B 9/18*** | (2006.01) |
| ***E04B 9/24*** | (2006.01) |
| *E04B 9/06* | (2006.01) |

(56) References Cited

U.S. PATENT DOCUMENTS 3,175,656 A * 3/1965 Schoenfeld ..... E04B 9/064 52/506.06
3,387,872 A * 6/1968 Lovullo ..... E04B 9/005 52/714
3,411,425 A * 11/1968 Lambert ..... F24F 13/072 454/303
3,550,341 A * 12/1970 Thompson ..... E04B 9/0485 52/506.09
4,541,216 A * 9/1985 Head ..... E04B 9/0478 52/506.08
4,648,229 A * 3/1987 Limp ..... E04B 9/28 52/506.08
4,683,699 A * 8/1987 Larsson ..... E04B 9/064 52/775
4,848,054 A * 7/1989 Blitzer ..... E04B 9/005 52/506.07
4,967,530 A * 11/1990 Clunn ..... E04B 9/02 52/204.591
4,986,050 A * 1/1991 Brunetti ..... F24F 13/28 52/506.08
5,123,225 A * 6/1992 Goodworth ..... E04B 2/7409 52/127.8
5,182,893 A * 2/1993 Goodworth ..... E04B 2/7409 52/745.05
5,279,632 A * 1/1994 Decker ..... B01D 46/0005 52/506.06
5,369,928 A * 12/1994 Goodworth ..... E04B 2/7409 52/489.1
5,809,730 A * 9/1998 Renz ..... F24F 13/28 52/506.09
5,822,941 A * 10/1998 Kinsella ..... E04B 9/28 52/506.05
8,046,966 B2 * 11/2011 Moore ..... E04B 9/30 52/506.06
2005/0000184 A1 * 1/2005 Nanayakkara ..... E04C 3/07 52/831
2007/0101670 A1 * 5/2007 Ahren ..... E04B 9/28 52/522
2008/0086962 A1 * 4/2008 Jahn ..... E04B 9/26 52/220.6
2016/0252196 A1 * 9/2016 Meister ..... F16B 2/065 248/62
2017/0009451 A1 * 1/2017 Sareyka ..... E04B 9/068
2017/0362829 A1 * 12/2017 Satterfield ..... E04B 9/04
2020/0123771 A1 * 4/2020 Gould ..... E04B 9/28

FOREIGN PATENT DOCUMENTS

| | | | |
|---|---|---|---|
| JP | H06240810 | A | 8/1994 |
| KR | 20090115988 | A | 11/2009 |
| KR | 20100008927 | A | 1/2010 |

OTHER PUBLICATIONS

Search Report from UK Intellectual Property Office in GB1710939.8 dated Dec. 19, 2018.

* cited by examiner

SUSPENDED CEILING ARRANGEMENTS

BACKGROUND OF THE INVENTION

1. Field of the Invention

The present invention relates to suspended ceiling arrangements, particularly but not exclusively suspended ceiling arrangements for cleanroom applications.

2. The Prior Art

Cleanrooms are rooms which are constructed to provide smooth, crevice free, sealed, exposed surfaces which reduce entrapment of dirt and contamination, are easy to clean and are designed to withstand regular intensive cleaning. In some cases, positive or negative air pressure may be applied to the room, which must also be withstood by the surfaces. Examples of cleanroom applications are found in hospitals, laboratories, manufacturing, universities and research facilities.

Conventionally, suspended ceiling arrangements are used in cleanroom applications. However, conventional arrangements are relatively complex, have to be bespoke designed for each room, and are relatively difficult to install and maintain.

In this specification, the terms upward and downward and other similar orientation terms are used in relation to the in use orientation of a ceiling, in which, for example, "downward" means down into a room. The terms "inward" and "outward" are used in relation to a central region of a particular component.

SUMMARY OF THE INVENTION

According to a first aspect of the present invention, there is provided a suspended ceiling arrangement for cleanroom applications, the arrangement including:

an elongate support member including: a base wall extending longitudinally and having at least one longitudinal base side edge; a side wall extending upwardly in use from the support member base side edge; and a flange part, which extends inwardly in use from the side wall, the flange part including an inwardly projecting tab, the base wall, the side wall, the flange part and the tab defining a longitudinally extending support channel, a ceiling member including a base wall having at least one longitudinal base side edge; a side wall extending upwardly in use from the ceiling member base side edge; a flange part extending outwardly in use from the side wall; and a lip part extending downwardly in use from the flange part, the lip part defining a gap therein, wherein, in use, in an installed condition, the ceiling member flange part locates on top of the support member flange part, the lip part locates in the support channel and the tab locates in the gap.

Possibly, the ceiling member side wall, the ceiling member flange part and the lip part define a longitudinally extending receiving channel, which, in the installed condition, receives the support member flange part.

Possibly, the support member includes: a pair of the longitudinal base side edges, one on each side of the base wall; a pair of the side walls, one extending upwardly in use from each of the support member base side edges; and two of the flange parts, one extending inwardly in use from each of the side walls, each of the flange parts including one inwardly projecting tab, the base wall, the side walls, the flange parts and the tabs defining the longitudinally extending support channel.

Possibly, in use, in the installed condition, the support member supports a ceiling member on each side. Possibly, in the installed condition, the ceiling member flange part of each ceiling member locates on top of a different one of the support member flange parts, the lip part of each ceiling member locates in the support channel and each of the tabs of the support member locates in the gap defined by a different ceiling member.

Possibly, the ceiling member includes: a pair of the longitudinal base side edges, one on each side of the base wall; a pair of the side walls, one extending upwardly in use from each of the ceiling member base side edges; two of the flange parts, one extending outwardly in use from each of the side walls; and two of the lip parts, each lip part extending downwardly in use from one of the flange parts, each of the lip parts defining one gap therein, the flange parts, the side walls and the lip parts defining two of the longitudinally extending receiving channels, one on each side of the ceiling member.

Possibly, in use, in the installed condition, the ceiling member is supported on each side by one of the support members. Possibly, in use, in the installed condition, each of the ceiling member flange parts locates on top of a different one of the support member flange parts, each of the lip parts locates in a different one of the support channels and the tab of each support member locates in the gap defined by a different one of the lip parts.

Possibly, each support member flange part includes a plurality of tabs, which may be spaced apart, possibly at a regular spacing. Possibly, each ceiling member lip part defines a plurality of gaps, which in use may correspond in number and location to the number and location of the support member flange part tabs.

Possibly, in use, in the installed condition, the side walls of adjacent support members and ceiling members are separated by a sealable gap. Possibly, in use, in the installed condition, the sealable gap is sealed by a seal. Possibly, the seal is formed in situ and may be formed of a mastic material.

Possibly, the ceiling arrangement includes a location formation, which may provide, in use, tactile confirmation to a user that the ceiling member is correctly located in the installed condition and/or may assist retention of the arrangement in the installed condition. Possibly, both the support member and the ceiling member include a location formation, which inter-engage to provide the tactile confirmation and/or assist retention. Possibly, one of the location formations defines a recess and the other includes an outwardly projecting raised projection, which in the installed condition is received within the recess. Possibly, the recess and the projection correspond in size, shape and location in the installed condition, and may be dome shaped. Possibly, the support member side wall includes the location formation which defines the recess and the ceiling member side wall includes the location formation which includes the projection.

Possibly, each of the support member and the ceiling member include a plurality of spaced location formations, which, in the installed condition, may correspond in location.

Possibly, the ceiling arrangement includes a mounting for mounting the support member to a support location such as a ceiling or wall. Possibly, the mounting includes a support hanger which includes a hook part for engaging the support member.

Possibly, the hook part comprises an engaging surface which, in the installed condition, may locate under and against the support member flange part to support the support member.

Possibly, the support hanger includes a pair of oppositely laterally extending hook parts, each of which comprises one of the engaging surfaces and which, in the installed condition, locate under and against a different one of the support member flange parts.

Possibly, both the support member base wall and the ceiling member base wall each include an in use downwardly directed surface, which surfaces, in the installed condition, may be substantially flush with each other. Possibly, the downwardly directed surfaces comprise part of a room surface which is exposed in use.

Possibly, the support member includes a light emitting device, such as a luminaire.

According to a second aspect of the present invention, there is provided a method of forming a suspended ceiling for a cleanroom application, the method including providing a suspended ceiling arrangement, the arrangement including:

an elongate support member including: a base wall extending longitudinally and having at least one longitudinal base side edge; a side wall extending upwardly in use from the support member base side edge; and a flange part, which extends inwardly in use from the side wall, the flange part including an inwardly projecting tab, the base wall, the side wall, the flange part and the tab defining a longitudinally extending support channel, a ceiling member including a base wall having at least one longitudinal base side edge; a side wall extending upwardly in use from the ceiling member base side edge; a flange part extending outwardly in use from the side wall; and a lip part extending downwardly in use from the flange part, the lip part defining a gap therein, wherein, in use, in an installed condition, the ceiling member flange part locates on top of the support member flange part, the lip part locates in the support channel and the tab locates in the gap.

Possibly, the arrangement includes any of the features described in any of the preceding statements or following description. Possibly, the method includes any of the steps described in any of the preceding statements or following description.

BRIEF DESCRIPTION OF THE DRAWINGS

An embodiment of the present invention will now be described, by way of example only, and with reference to the accompanying drawings, in which.

Figure 1:
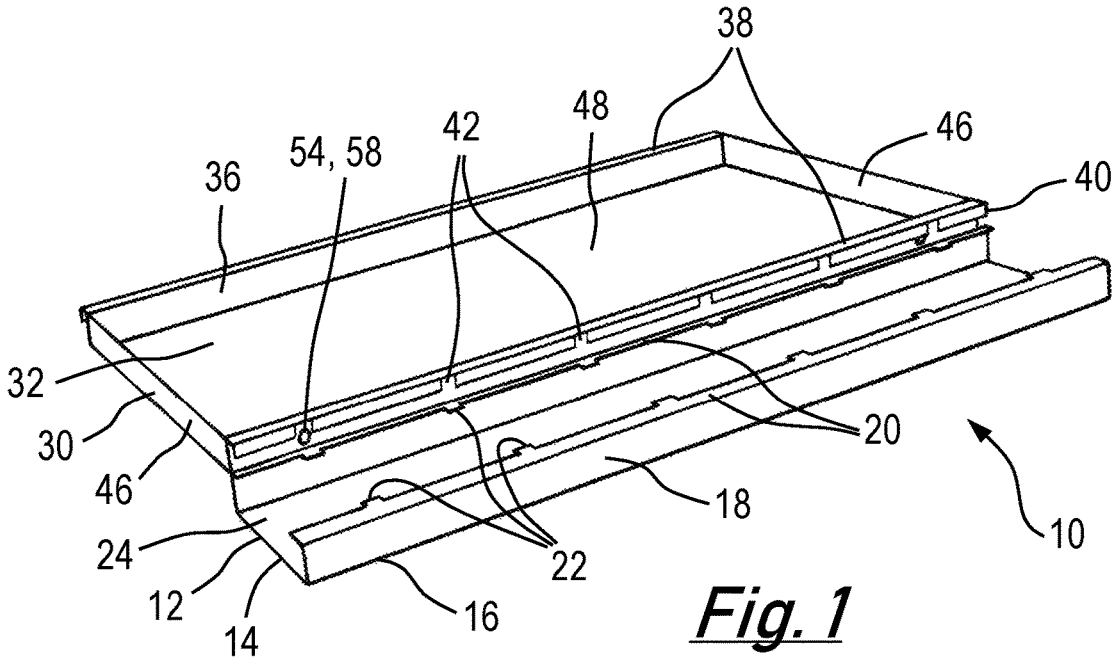
FIG. 1 is a perspective view of a support member and a ceiling member of a suspended ceiling arrangement before assembly.
Figure 2:
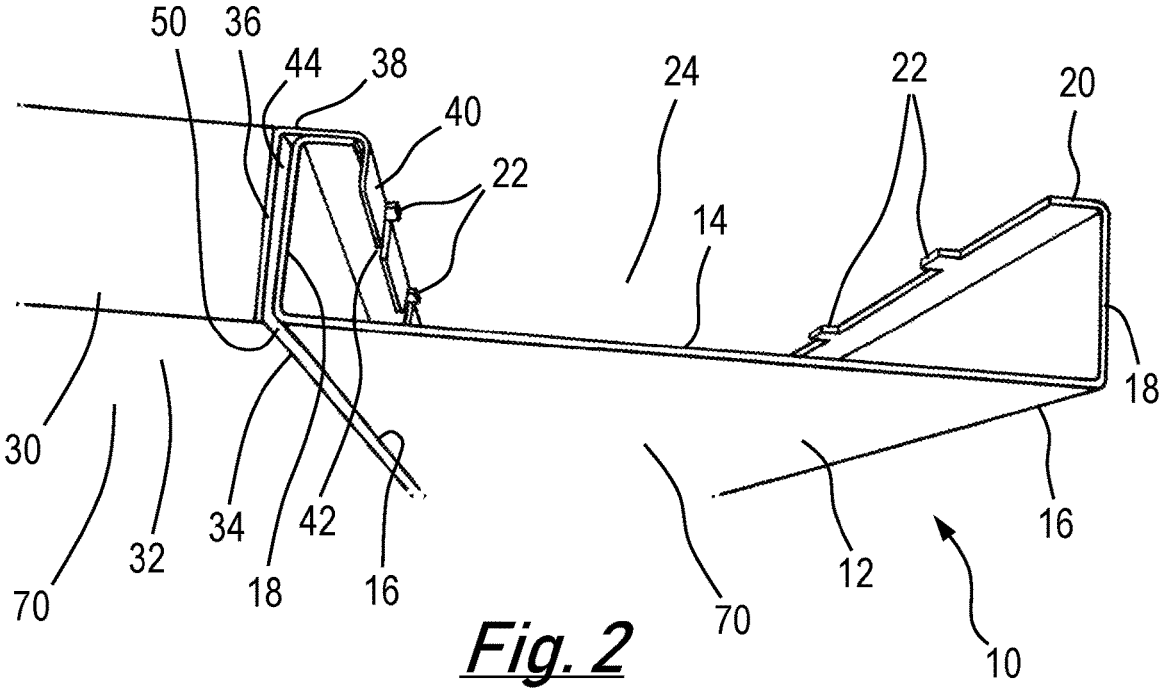
FIG. 2 is a perspective view of the support member and the ceiling member assembled together.
Figure 3:
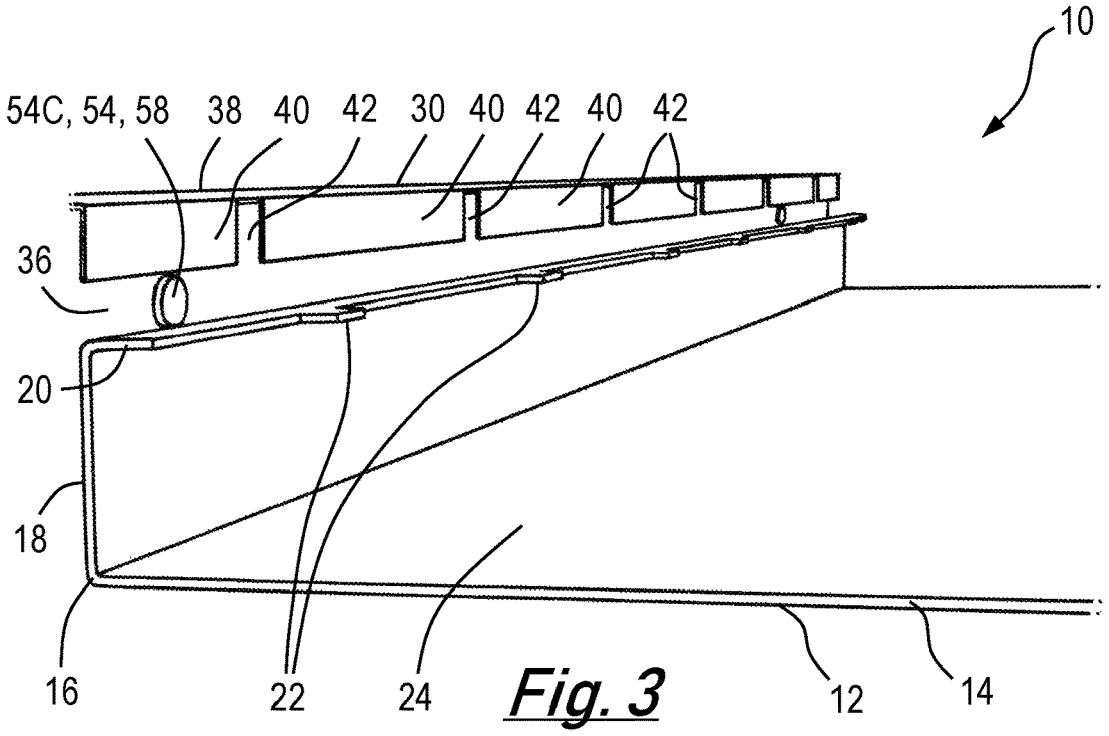
FIG. 3 is a perspective view of the support member and the ceiling member before assembly.
Figure 4:
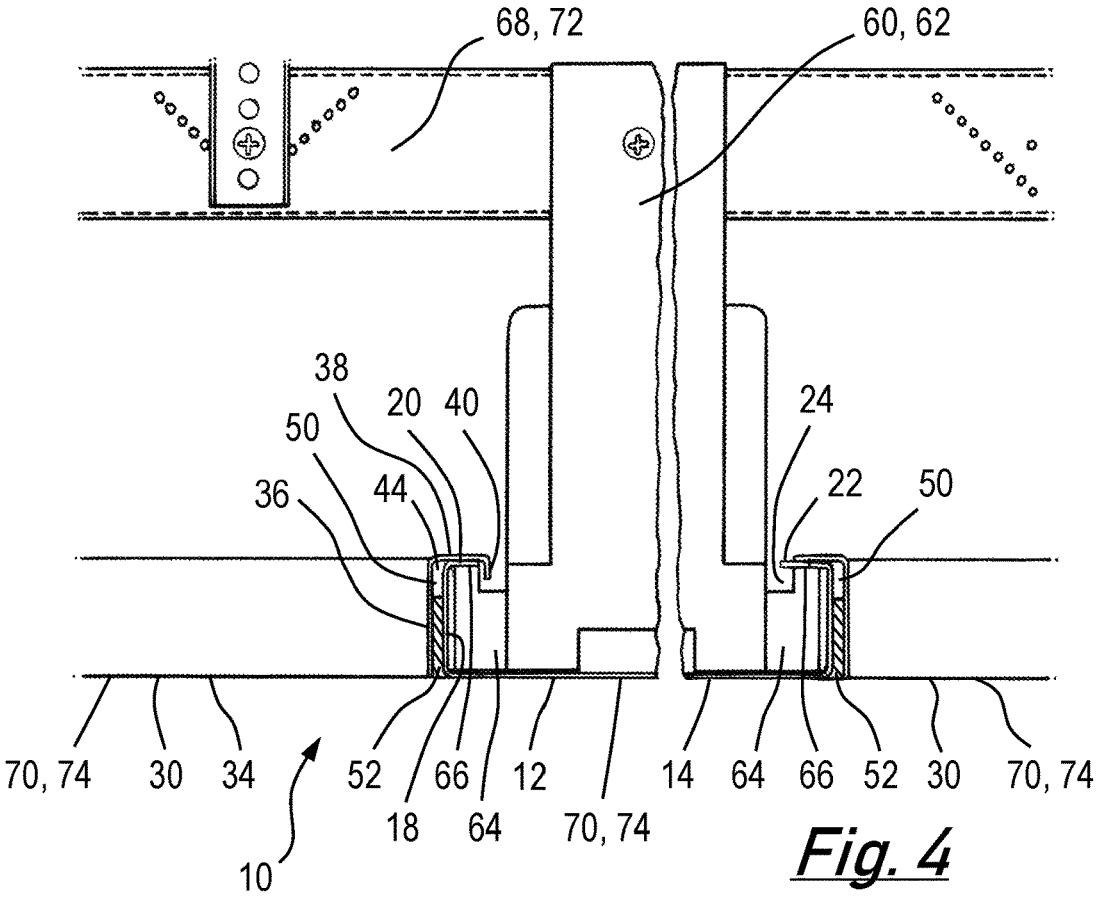
FIG. 4 is a cross sectional end view of the ceiling arrangement in the installed condition.

In the drawings, where multiple instances of the same or similar features exist, only a representative one or some of the instances of the features have been provided with numeric references for clarity.

DETAILED DESCRIPTION OF THE PREFERRED EMBODIMENTS

FIGS. 1 to 6 show a suspended ceiling arrangement 10 for cleanroom applications. The arrangement 10 includes an elongate support member 12. The support member 12 includes: a base wall 14 extending longitudinally and having at least one longitudinal base side edge 16; a side wall 18 extending upwardly in use from the support member base side edge 16; and a flange part 20, which extends inwardly in use from the side wall 18, the flange part 20 including an inwardly projecting tab 22, the base wall 14, the side wall 18, the flange part 20 and the tab 22 defining a longitudinally extending support channel 24.

The ceiling arrangement 10 includes a ceiling member 30. The ceiling member 30 includes a base wall 32 having at least one longitudinal base side edge 34; a side wall 36 extending upwardly in use from the ceiling member base side edge 34; a flange part 38 extending outwardly in use from the side wall 36; and a lip part 40 extending downwardly in use from the flange part 38, the lip part 40 defining a gap 42 therein.

In use, in an installed condition, the ceiling member flange part 38 locates on top of the support member flange part 20, the lip part 40 locates in the support channel 24 and the tab 22 locates in the gap 42.

The ceiling member side wall 36, the ceiling member flange part 38 and the lip part 40 define a longitudinally extending receiving channel 44, which, in the installed condition, receives the support member flange part 20.

In the example shown, the support member 12 includes: a pair of the longitudinal base side edges 16, one on each side of the base wall 14; a pair of the side walls 18, one extending upwardly in use from each of the support member base side edges 16; and two flange parts 20, one extending inwardly in use from each of the side walls 18, each of the flange parts 20 including a plurality of the inwardly projecting tabs 22. The base wall 14, the side walls 18, the flange parts 20 and the tabs 22 define the longitudinally extending support channel 24.

In the example shown, the ceiling member 30 includes: a pair of the longitudinal base side edges 34, one on each side of the base wall 32; a pair of the side walls 36, one extending upwardly in use from each of the ceiling member base side edges 34; two of the flange parts 38, one extending outwardly in use from each of the side walls 36; and two of the lip parts 40, each lip part 40 extending downwardly in use from one of the flange parts 38, each of the lip parts 40 defining a plurality of the gaps 42 therein. The flange parts 38, the side walls 36 and the lip parts 40 define two of the longitudinally extending receiving channels 44, one on each side of the ceiling member 30.

The support member flange part tabs 22 are spaced apart at a regular spacing. The ceiling member lip part gaps 42 correspond in number and location to the number and location of the support member flange part tabs 22.

In the example shown, the ceiling member 30 includes a pair of end walls 46 which extend upwardly in use from opposite end edges of the base wall 32 and form corner joints with the side walls 36 to define an interior 48.

The ceiling arrangement 10 includes a location formation 54, which, in use, provides tactile confirmation to a user that the ceiling member 30 is correctly located in the installed condition and assists retention of the ceiling member 30 in the installed condition. In the example shown, both the support member 12 and the ceiling member 30 include a plurality of spaced location formations 54, (designated 54S and 54C respectively) which inter-engage to provide the tactile confirmation and assist retention.

In the example shown, each of the support member location formations 54S defines a recess 56 and each of the ceiling member location formations 54C includes an outwardly projecting raised projection 58. In the installed condition, the projections 58 are received within the recesses 56. The recesses 56 and the projections 58 correspond in size, shape and location in the installed condition, and are dome shaped. The support member side walls 18 include the support member location formations 54S and the ceiling member side walls 36 include the ceiling member location formations 54C.

The ceiling arrangement 10 includes a mounting 60 for mounting the support member 12 to a support location 72 such as a ceiling or wall. The mounting 60 includes a support hanger 62 which includes a pair of oppositely extending hook parts 64 for engaging the support member 12. Each hook part 64 comprises an in use upwardly directed engaging surface 66.

In use, the ceiling arrangement 10 is assembled as follows.

The hangers 62 are located on to the support locations 72, for example, ceiling joists 68. The hangers 62 could be fixed by fasteners (not shown) such as bolts to the joists 68.

The support members 12 are located on to the hook parts 64 of the hangers 62. In the installed condition, each of the hook part engaging surfaces 66 locates under and against a different one of the support member flange parts 20 to support the support member 12.

The ceiling members 30 are then located onto the support members 12, by locating the ceiling member flange parts 38 on to the support member flange parts 20, with the tabs 22 locating in the gaps 42.

As the ceiling members 30 locate into position on the support members 12, the projections 58 provide a degree of resistance to the locating movement. As the projections 58 seat into the recesses 56 in the installed condition, the user can feel the resistance ease, providing tactile confirmation that the installed condition has been reached. Also, the location of the projections 58 in the recesses 56 provides resistance to movement of the ceiling members 30 out of the installed condition, thus providing a securing/retaining function.

In one example, the ceiling arrangement 10 in the installed condition comprises one or more lines of support members 12, with each support member 12 supporting one or more ceiling members 30 on either one or both sides of the line, and each ceiling member 30 being supported on both sides by one of the support members 12. At the edges of the ceiling arrangement 10, the line of support members 12 could support ceiling members 30 only on one side of the line.

In the installed condition, the ceiling member flange parts 38 of each ceiling member 30 locate on top of a different one of the support member flange parts 20, the lip parts 40 locate in a different one of the support channels 24 and each of the tabs 22 of the support members 12 locates in a different one of the gaps 42.

In use, in the installed condition, the side walls 18, 36 of adjacent support members 12 and ceiling members 30 are separated by a sealable gap 50. In use, in the installed condition, the sealable gap 50 is sealed by a seal 52. The seal 52 could be formed in situ, of, for example, a mastic material.

Both the support member base wall 14 and the ceiling member base wall 32 each include an in use downwardly directed surface 70, which surfaces 70, in the installed condition, are substantially flush with each other. In the installed condition, the downwardly directed surfaces 70 comprise part of a room surface 74, which is exposed in use.

Figure 5A:
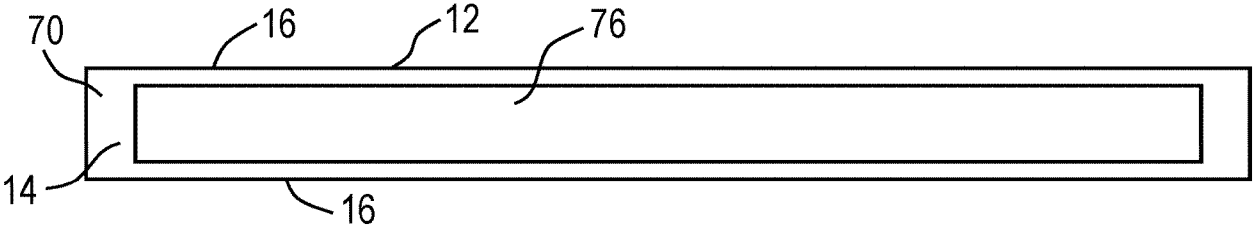
FIGS. 5A, 5B, 5C, 5D and 5E are, respectively, a view from below, a side view, a plan view from above, a cross sectional end view and a detail of a flange part (as indicated by arrow V in FIG. 5D) of the support member.
Figure 5B:
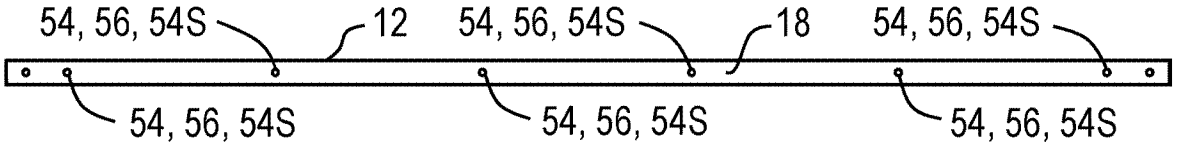
Figure 5C:
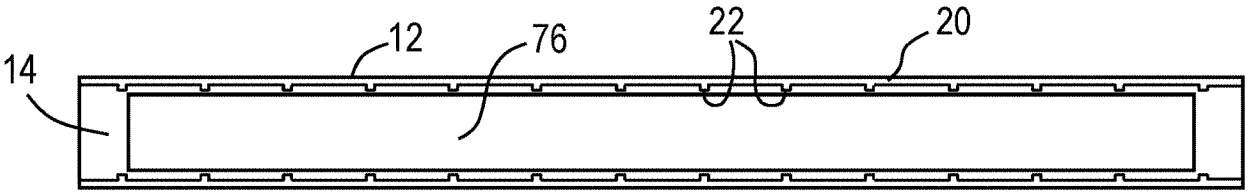
Figure 5D:
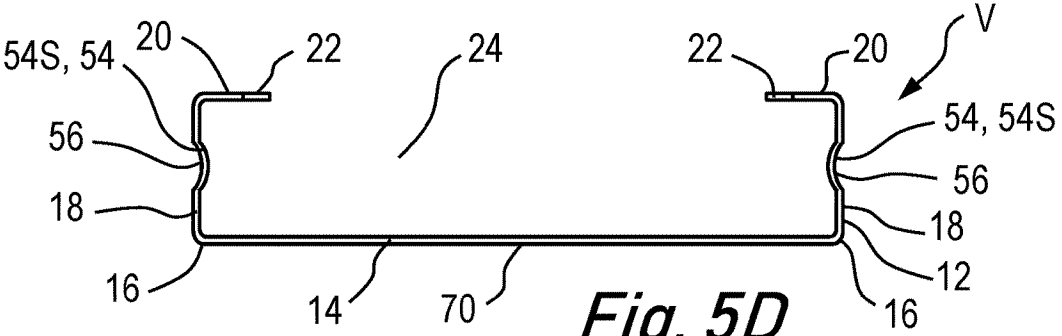
Figure 5E:
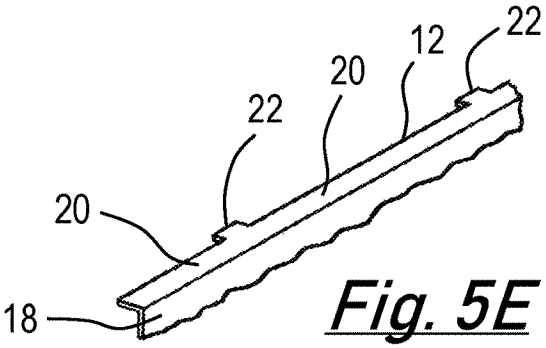
Figure 6A:
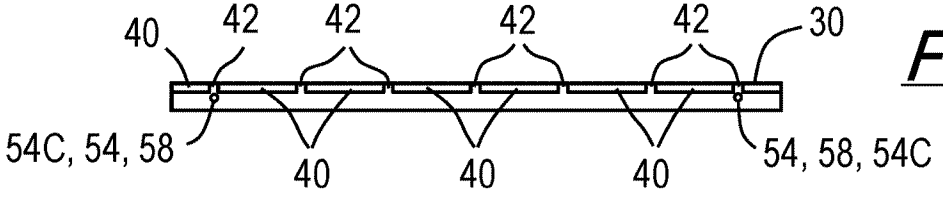
FIGS. 6A, 6B, 6C and 6D are, respectively, a side view, a cross sectional end view, a plan view from above and a detail of a side wall and a flange part (as indicated by the circled part in FIG. 6B) of the ceiling member.
Figure 6B:
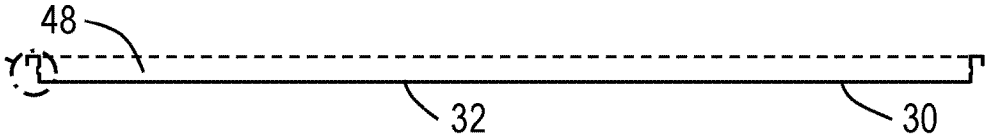
Figure 6C:
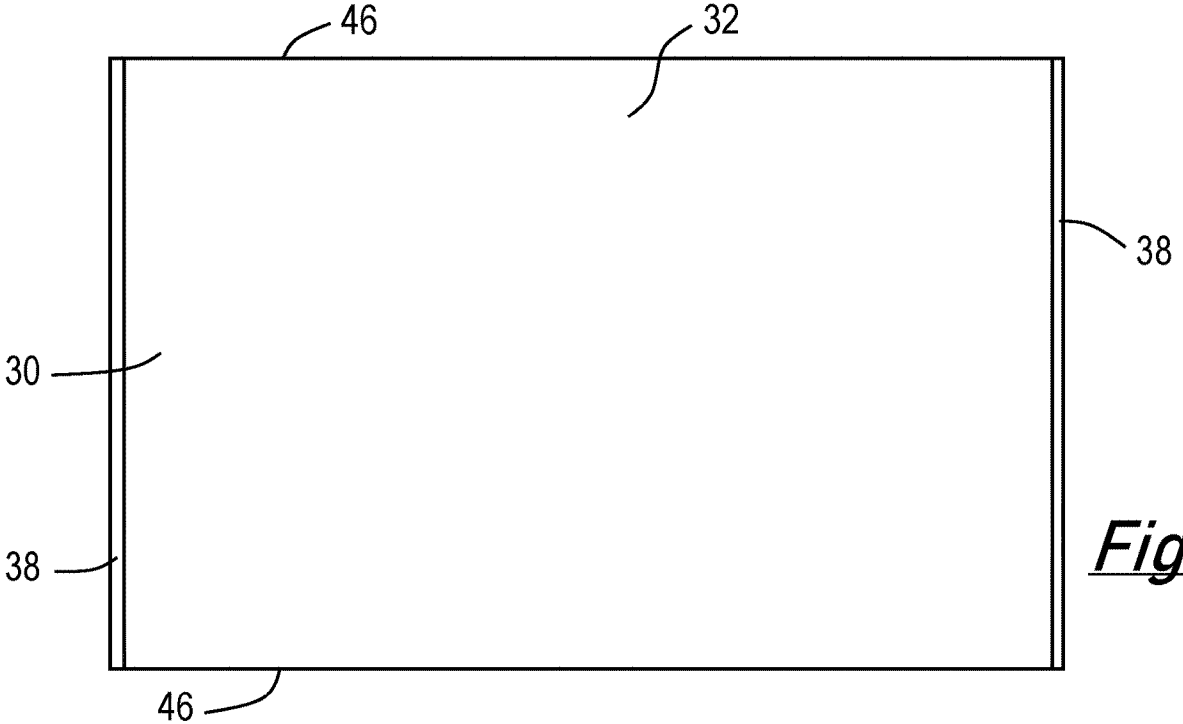
Figure 6D:
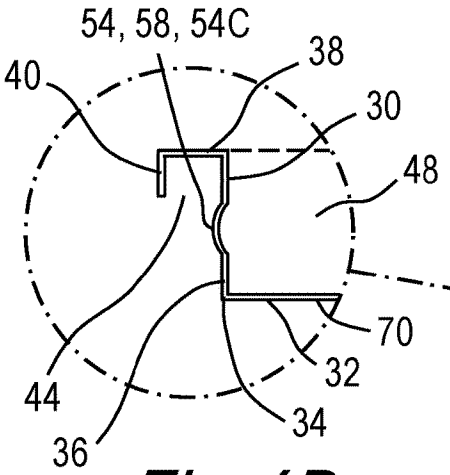

In one example, the support member 12 could include a light emitting device 76, such as a luminaire, an example of the location of which is indicated in FIGS. 5A and 5C.

Advantageously, the location of the tabs 22 in the gaps 42 provides positive, secure in use longitudinal positioning and locking of the ceiling members 30 along the line of the support members 12. The location of the projections 58 in the recesses 56 provides further location guidance and security both longitudinally and vertically in use. Cleanroom applications require careful installation and maintenance to achieve and maintain the required hygienic/cleanroom design and operating specification, and these features aid installation and maintenance, thus reducing costs.

Other Modifications

Various other modifications could be made without departing from the scope of the invention. The ceiling arrangement and the various components thereof could be of any suitable size and shape, and could be formed of any suitable material (within the scope of the specific definitions herein).

The number, location, size and shape of the tabs, the gaps, and the location formations could vary from that shown.

There is thus provided a ceiling arrangement with a number of advantages over conventional arrangements. The components are relatively simple and can be made in modular sizes to suit a variety of room sizes. The components can be more easily installed and maintained to a hygienic/cleanroom design and operating specification than conventional arrangements.

What is claimed is:

1. A suspended ceiling for cleanroom applications comprising:

an elongate support member including: a base wall extending longitudinally and having a first longitudinal base side edge; a first side wall extending upwardly from the support member base side edge; and a first flange part, which extends inwardly from the first side wall, the first flange part including a first inwardly projecting tab, the base wall, the side wall, the first flange part and the tab defining a first longitudinally extending support channel; and a first ceiling member including a base wall having a first longitudinal base side edge; a first side wall having two sides extending upwardly from the ceiling member base side edge; a first flange part extending outwardly from the side wall; and a first lip part extending downwardly from the first flange part, the first lip part defining a gap therein, wherein in an installed condition, the ceiling member flange part is located on top of the support member flange part, the lip part is located in the support channel and the tab is located in the gap.

2. The suspended ceiling according to claim 1, in which the ceiling member side wall, the ceiling member flange part and the lip part define a longitudinally extending receiving channel, which, in the installed condition, receives the support member flange part.

3. The suspended ceiling according to claim 1, wherein the base wall has two sides; wherein the support member includes: the first longitudinal base side edge on one side of the base wall and a second longitudinal base side edge on the other side of the base wall; the first side wall extending upwardly from the first longitudinal base side edge and a second side wall extending upwardly from the second longitudinal base side edge; and the first flange part extending inwardly from the first side wall and a second flange part having a second tab extending inwardly from the second side wall, each of the flange parts including one inwardly projecting tab, the base wall, the first and second side walls, the first and second flange parts and the tabs defining the longitudinally extending support channel.

4. The suspended ceiling according to claim 3, wherein the suspended ceiling further includes a second ceiling member with a second flange part, a second lip part and a second gap;

wherein the support member has two sides and wherein the support member supports the first ceiling member on each one side and the second ceiling member on the other side, and wherein the first and second ceiling member flange parts are located on top of the first and second support member flange parts, respectively; the first and second lip part parts are located in the support channel; and each of the first and second tabs is located in the gap defined by a different ceiling member.

5. The suspended ceiling according to claim 1, in which the ceiling member has two sides and includes:

the first longitudinal base side edge located on one side of the base wall; and a second longitudinal base side edge located on the other side of the base wall;

the first side wall extending upwardly from the first ceiling member base side edge; and a second side wall extending upwardly from the second ceiling member base side edge;

the first flange part extending outwardly from the first side wall; and a second flange part extending outwardly from the second side wall; and the first lip part extending downwardly from the first flange part, and a second lip part extending downwardly from the second flange part; where each of the lip parts defining one gap therein, wherein the first and second flange parts, the first and second side walls and the first and second lip parts defining two longitudinally extending receiving channels, one on each side of the ceiling member.

6. The suspended ceiling according to claim 5, wherein the elongate support member includes a second flange part and a second tab, the second flange part and the second tab defining a second longitudinally extending support channel;

wherein each of the ceiling member flange parts is located on top of a different one of the support member flange parts, each of the lip parts is located in a different one of the support channels and the tab of each support member is located in the gap defined by a different one of the lip parts.

7. The suspended ceiling according to claim 1, in which the support member first flange part includes a plurality of tabs which are spaced apart and the ceiling member first lip part defines a plurality of gaps, which corresponds in number and location to a number and a location of the support member first flange part tabs.

8. The suspended ceiling according to claim 1, in which the suspended ceiling includes one of: a location formation providing tactile confirmation to a user that the ceiling member is located in the installed condition; and a location formation providing retention of the suspended ceiling in the installed condition.

9. The suspended ceiling according to claim 1, in which the suspended ceiling includes one of: a location formation providing tactile confirmation to a user that the ceiling member is located in the installed condition; and a location formation providing retention of the suspended ceiling in the installed condition, wherein both the support member and the ceiling member include a location formation which inter-engage.

10. The suspended ceiling according to claim 1, in which the suspended ceiling includes one of: a location formation providing tactile confirmation to a user that the ceiling member is located in the installed condition; and a location formation providing retention of the suspended ceiling in the installed condition, wherein both the support member and the ceiling member include a location formation which inter-engage and wherein one of the location formations defines a recess and the other includes an outwardly projecting raised projection, which in the installed condition is received within the recess.

11. The suspended ceiling according to claim 1, in which the suspended ceiling includes one of: a location formation providing tactile confirmation to a user that the ceiling member is located in the installed condition; and a location formation providing retention of the suspended ceiling in the installed condition, wherein both the support member and the ceiling member include a location formation which inter-engage and wherein one of the location formations defines a recess and the other includes an outwardly projecting dome-shaped raised projection, which in the installed condition is received within the recess, wherein the recess and the projection correspond in size, shape and location in the installed condition.

12. The suspended ceiling according to claim 1, in which the suspended ceiling includes a mounting bracket for mounting the support member to an existing support location, the mounting bracket including a support hanger which includes a hook part for engaging the support member, the hook part comprising an engaging surface which, in the installed condition, locates under and against the support member flange part to support the support member.

13. The suspended ceiling according to claim 1, in which the suspended ceiling includes a mounting bracket for mounting the support member to a an existing support location, the mounting bracket including a support hanger which includes a hook part for engaging the support member, the hook part comprising an engaging surface which, in the installed condition, is located under and against the support member flange part to support the support member, and wherein the support hanger includes a pair of oppositely laterally extending hook parts, each of which comprises one of the engaging surfaces and which, in the installed condition, is located under and against a different one of the support member flange parts.

14. The suspended ceiling according to claim 1, in which both the support member base wall and the ceiling member base wall each include a downwardly directed surface, the downwardly directed surfaces being substantially flush with each other.

15. The suspended ceiling according to claim 1, in which both the support member base wall and the ceiling member base wall each include a downwardly directed surface, the downwardly directed surfaces, in the installed condition, are substantially flush with each other, and in which each of the downwardly directed surfaces comprises a part of a room surface which is exposed.

16. The suspended ceiling according to claim 1, in which the support member includes one of a light and a luminaire.

17. A method of forming a suspended ceiling for a cleanroom application comprising:

providing a first elongate support member including: a base wall having two sides extending longitudinally and having a first longitudinal base side edge; a first side wall extending upwardly from the support member base side edge; and a flange part, which extends inwardly from the side wall, the flange part including an inwardly projecting tab, the base wall, the side wall, the flange part and the tab defining a first longitudinally extending support channel, further providing a ceiling member with two sides including a base wall having a first longitudinal base side edge; a side wall extending upwardly from the ceiling member base side edge; a first flange part extending outwardly from the side wall; and a first lip part extending downwardly from the first flange part, the first lip part defining a gap therein, wherein in an installed condition, locating the ceiling member first flange part on top of the support member flange part, locating the first lip part in the support channel, and locating the tab in the gap.

18. The method according to claim 17 further including one or more of:

a second elongate support member and a second longitudinally extending support channel;

the first longitudinal base side edge on one side of the base wall, and a second longitudinal base side edge on the other side of the base wall;

the first side wall extending upwardly from the ceiling member first base side edge, and a second side wall extending upwardly from a second base edge of the ceiling member;

the first flange part extending outwardly from the first side wall, and a second flange part extending outwardly from a second side wall; and the first lip part extending downwardly from the first flange part, and a second lip part extending downwardly from a second flange part, each lip parts defining one gap therein, the first and second flange parts, the first and second side walls and the first and second lip parts defining two longitudinally extending receiving channels, one on each side of the ceiling member, in the installed condition, the ceiling member is supported on each side by one of the first and second elongate support members, wherein the first and second ceiling member flange parts are located on top of a different one of the support member flange parts, each of the first and second lip parts is located in a different one of the support channels and the tab of each support member is located in the gap defined by a different one of the lip parts.

19. The method according to claim 18, wherein the suspended ceiling further includes one of: a location formation-providing tactile confirmation to a user that the ceiling member is located in the installed condition; and a location formation providing retention of the suspended ceiling in the installed condition, wherein both the support member and the ceiling member include a location formation, which inter-engage to provide the tactile confirmation and wherein one of the location formations defines a recess and the other includes an outwardly projecting raised projection, which in the installed condition is received within the recess.

20. The method according to claim 19, further including:

a mounting bracket for mounting the support member to an existing support location, the mounting bracket including a support hanger which includes a hook part for engaging the support member, the hook part comprising an engaging surface which, in the installed condition, is located under and against the support member flange part to support the support member, and wherein the support hanger includes a pair of oppositely laterally extending hook parts, each of which comprises one of the engaging surfaces and which, in the installed condition, is located under and against a different one of the support member flange parts.

* * * * *